US011458361B1

(12) United States Patent
Page

(10) Patent No.: US 11,458,361 B1
(45) Date of Patent: Oct. 4, 2022

(54) LUNG EXERCISE APPARATUS AND METHOD

(71) Applicant: Arthur Lee Page, Pensacola, FL (US)

(72) Inventor: Arthur Lee Page, Pensacola, FL (US)

( * ) Notice: Subject to any disclaimer, the term of this patent is extended or adjusted under 35 U.S.C. 154(b) by 18 days.

(21) Appl. No.: 17/326,411

(22) Filed: May 21, 2021

Related U.S. Application Data

(60) Provisional application No. 63/102,196, filed on Jun. 5, 2020.

(51) Int. Cl.
*A63B 23/18* (2006.01)

(52) U.S. Cl.
CPC ..... *A63B 23/18* (2013.01); *A63B 2208/0204* (2013.01); *A63B 2208/029* (2013.01); *A63B 2225/60* (2013.01); *A63B 2225/64* (2013.01)

(58) Field of Classification Search
CPC ..... A63B 23/18; A63B 2208/0204; A63B 2208/029; A63B 2225/60; A63B 2225/64
See application file for complete search history.

(56) References Cited

U.S. PATENT DOCUMENTS 2,825,224 A * 3/1958 Lindenauer ..... A63B 69/12 434/254
3,445,941 A * 5/1969 Burke ..... A63B 69/12 434/254
3,861,675 A * 1/1975 Hopper ..... A63B 69/12 482/55
4,095,657 A * 6/1978 Hohwart ..... A63B 69/12 434/254
4,247,096 A * 1/1981 Schmitt ..... A63B 69/12 273/DIG. 30
4,524,711 A * 6/1985 Ashrow ..... A63B 69/12 267/74
4,552,540 A * 11/1985 Bass ..... A63B 69/12 441/106
4,918,766 A * 4/1990 Leonaggeo, Jr. ..... A63B 22/02 482/4
4,948,117 A * 8/1990 Burke ..... A63B 69/12 482/129
4,948,118 A * 8/1990 Miraglia ..... A61H 3/008 482/69
5,020,791 A * 6/1991 Phillips ..... A63B 69/12 114/253
5,092,589 A * 3/1992 Packer ..... A63B 23/03575 482/92
5,103,508 A * 4/1992 Counts ..... E04H 4/0056 482/111
5,816,982 A * 10/1998 Croushore ..... A63B 69/12 482/55

(Continued)

*Primary Examiner* — Garrett K Atkinson
(74) *Attorney, Agent, or Firm* — J. Nevin Shaffer, Jr.

(57) ABSTRACT

A lung exercise apparatus and method with an enclosure, with an inside, an outside and an open top, configured to hold a liquid of a first density. An additive to the liquid that increases the first density such that a person in the liquid is more buoyant. Weight removably connectable with the person such that a person in the enclosure is held vertical in the enclosure and partially immersed in the liquid below a surface of the liquid and with some of a person's body above the surface of the liquid. And a harness that is removably connectable with the person to hold some of the person's body above the surface of the liquid where lungs in a person's body are below the surface of the liquid.

20 Claims, 2 Drawing Sheets

(56) References Cited

U.S. PATENT DOCUMENTS

| | | | | |
|---|---|---|---|---|
| 6,966,870 | B2 * | 11/2005 | Lan | A63B 69/12 434/254 |
| 7,104,932 | B1 * | 9/2006 | Brentlinger | A63B 69/12 434/254 |
| 7,175,569 | B1 * | 2/2007 | Lan | A63B 21/4009 434/254 |
| 7,699,760 | B2 * | 4/2010 | Hruska, Jr. | A63B 21/0084 4/541.3 |
| 9,265,990 | B2 * | 2/2016 | Reese | A63B 35/00 |
| 9,604,088 | B2 * | 3/2017 | Djang | A63B 21/0606 |
| 2004/0094083 | A1 * | 5/2004 | Mazin | B63C 11/46 114/315 |
| 2005/0159275 | A1 * | 7/2005 | Bullman | A63B 69/0035 482/111 |
| 2006/0166175 | A1 * | 7/2006 | Lan | A63B 69/12 434/254 |
| 2012/0264574 | A1 * | 10/2012 | Chang | A63B 69/12 482/55 |

* cited by examiner

LUNG EXERCISE APPARATUS AND METHOD

CROSS REFERENCE TO RELATED APPLICATION

This application claims the benefit of previously filed U.S. provisional patent application No. 63/102,196 filed Jun. 5, 2020 for a "submergion Lung Exercising/Health Enhancing Device". The Applicant hereby claims the benefit of this provisional application under 35 U.S.C. § 119. The entire content of this provisional application is incorporated herein by this reference.

FIELD OF THE INVENTION

This invention relates to an improved exercise device. In particular, in accordance with one embodiment, the invention relates to a lung exercise apparatus with an enclosure, with an inside, an outside and an open top, configured to hold a liquid of a first density. An additive to the liquid that increases the first density such that a person in the liquid is more buoyant. Weight removably connectable with the person such that a person in the enclosure is held vertical in the enclosure and partially immersed in the liquid below a surface of the liquid and with some of a person's body above the surface of the liquid. And a harness that is removably connectable with the person to hold some of the person's body above the surface of the liquid where lungs in a person's body are below the surface of the liquid.

BACKGROUND OF THE INVENTION

A problem exists in the art of exercise in that many otherwise fit individuals can not exercise in typical manner by running, jumping, swimming and such because of one physical ailment or another. A person with a leg, knee or ankle injury, for example can not exercise his or her lungs in any of those ways. Further, all of the prior art exercise systems add stress to portions of a user's body, arms and legs, for example, in order to add intensity to a work out. Ultimately, the desired effect is to increase health by exercising a person's muscles and, as a typical advantageous side effect, lungs as well. There is no known exercise system that exercises a person's lungs and surrounding muscles in an isolated manner without requiring moving arms and legs. Further, there is no known system that can provide such exercise, and even increase the exercise intensity, in a gravity-less environment.

Thus, there is a need in the art for an exercise system that exercises a person's lungs and surrounding muscles without requiring movement of arms or legs and that does so in a gravity-less environment.

It therefore is an object of this invention to provide a lung exercise apparatus and method for exercising a person's lungs without need of movement of arms or legs, in a gravity-less environment.

SUMMARY OF THE INVENTION

Accordingly, the improved lung exercise apparatus and method of the present invention, according to one embodiment, includes an enclosure, with an inside, an outside and an open top, configured to hold a liquid of a first density. An additive to the liquid is provided that increases the first density such that a person in the liquid is more buoyant. Weight is removably connectable with the person such that a person in the enclosure is held vertical in the enclosure and partially immersed in the liquid below a surface of the liquid and with some of a person's body above the surface of the liquid. And a harness is provided that is removably connectable with the person so as to hold some of the person's body above the surface of the liquid where lungs in a person's body are below the surface of the liquid.

All terms used herein are given their common meaning so that "enclosure", for example, identifies and describes a container for holding material within the limits of its construction.

In one aspect, the invention further includes a pump connected with the enclosure for circulating the liquid and the additive.

In one aspect, a heater is connected with the enclosure for heating the liquid. In one aspect, a thermometer is connected with the enclosure for measuring the temperature of liquid in the enclosure. In another aspect, a thermostat is connected with the heater for controlling the temperature of the heater.

In one aspect, insulation surrounds the enclosure. In another aspect, a waterproof mattress covers the inside of the enclosure.

In one aspect, the liquid is water and in one aspect, the additive is salt.

According to another embodiment, a lung exercise apparatus includes an enclosure, with an inside, an outside and an open top, configured to hold water with a first density at a water level below the open top and where the enclosure has an outside support exterior, an insulation layer and a waterproof mattress layer, the waterproof mattress layer forming the inside of the enclosure. An additive to the water increases the first density such that a person in the water is more buoyant. Weight is removably connected with a person such that a person in the enclosure is held vertically in the enclosure and partially immersed in the water below the water level of the water with some of a person's body above the water level of the water. A harness is removably connected with a person so as to hold some of the person's body above the water level of the water and where the lungs in a person's body are below the water level of the water. A pump is connected with the enclosure for circulating the water and the additive. A heater is connected with the enclosure for heating the water. A thermometer is connected with the enclosure for measuring the temperature of the water in the enclosure and a thermostat is connected with the heater for controlling the temperature of the heater.

In one aspect, the additive is salt and in another, the additive is sea salt.

In one aspect, the harness is configured to hold a person's head above the water level and in another, the harness is adjustable to hold a person's chin above the water level.

In one aspect, the weight consists of ankle weights.

In another aspect, the enclosure is located partially below ground level.

According to another embodiment, a lung exercise method consists of:

a. providing an enclosure, with an inside, an outside and an open top, configured to hold water with a first density at a water level below the open top where the enclosure has an outside support exterior, an insulation layer and a waterproof mattress layer, the waterproof mattress layer forming the inside of the enclosure; an additive to the water that increases the first density such that a person in the water is more buoyant; weight removably connectable with the person such that a person in the enclosure is held vertical in the enclosure and partially immersed in the water below the water level of the water and with some of a person's body above the water level of the water; a harness removably connectable with the person to hold some of the person's body above the water level of the water where lungs in a person's body are below the water level of the water; a pump connected with the enclosure for circulating the water and the additive; a heater connected with the enclosure for heating the water; a thermometer connected with the enclosure for measuring the temperature of the water in the enclosure and a thermostat connected with the heater for controlling the temperature of the heater; and b. attaching the weight and harness to a person in the water such that a person's head is above the water level and such that breathing in and out raises and lowers the water level and exercises the lungs of the person.

In one aspect, the method includes adding more additive such that the buoyancy is increased and adding more weight to compensate for the increased buoyancy whereby strain of exercising the lungs is increased.

In another aspect, the method includes a pump connected with enclosure for circulating the water and the additive; a heater connected with the enclosure for heating the water a thermometer connected with the enclosure for measuring the temperature of the water in the enclosure and a thermostat connected with the heater for controlling the temperature of the heater.

In one aspect, the enclosure is located partially below ground level.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
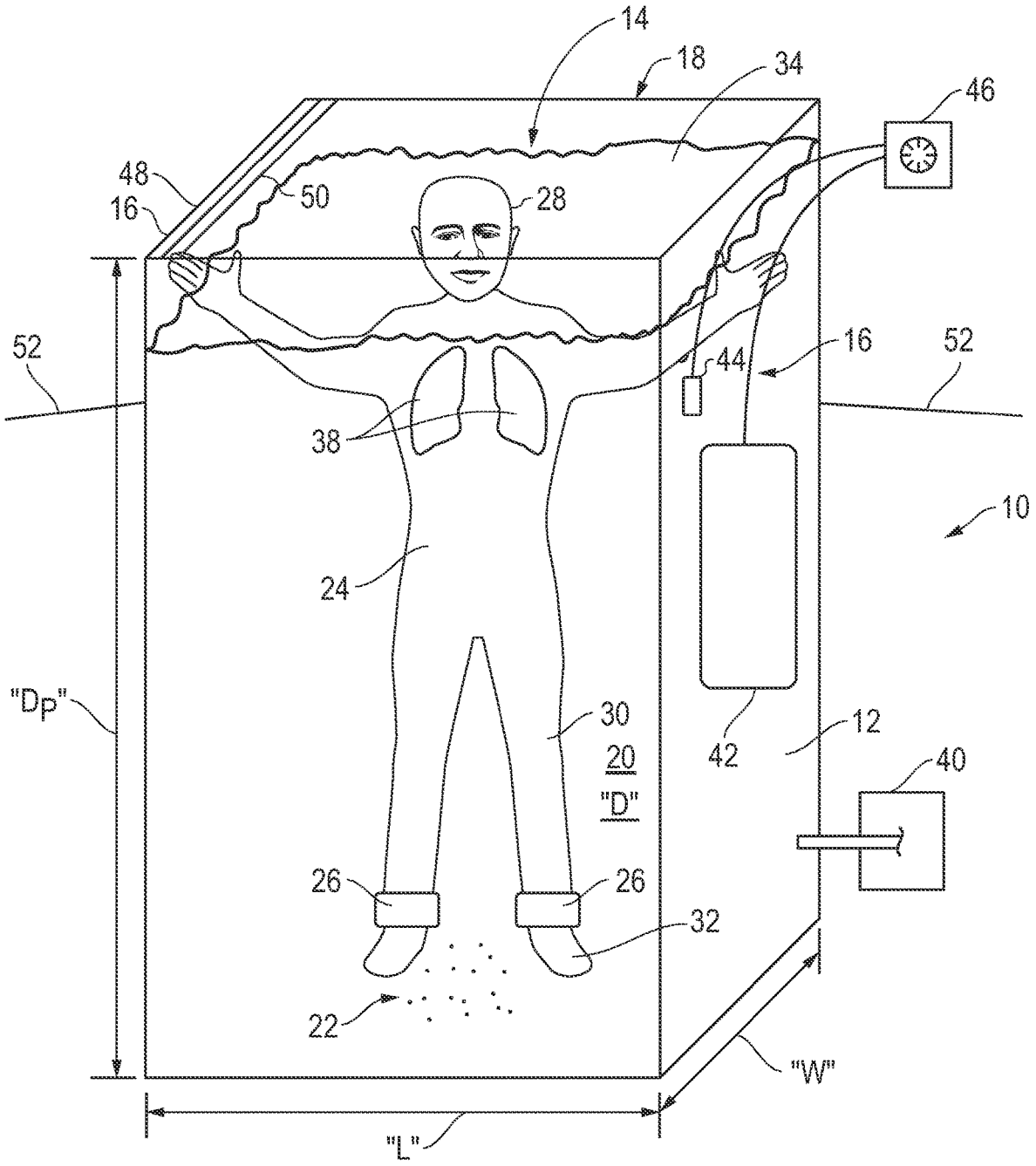
FIG. 1 is a side, perspective view of the lung exercise apparatus of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
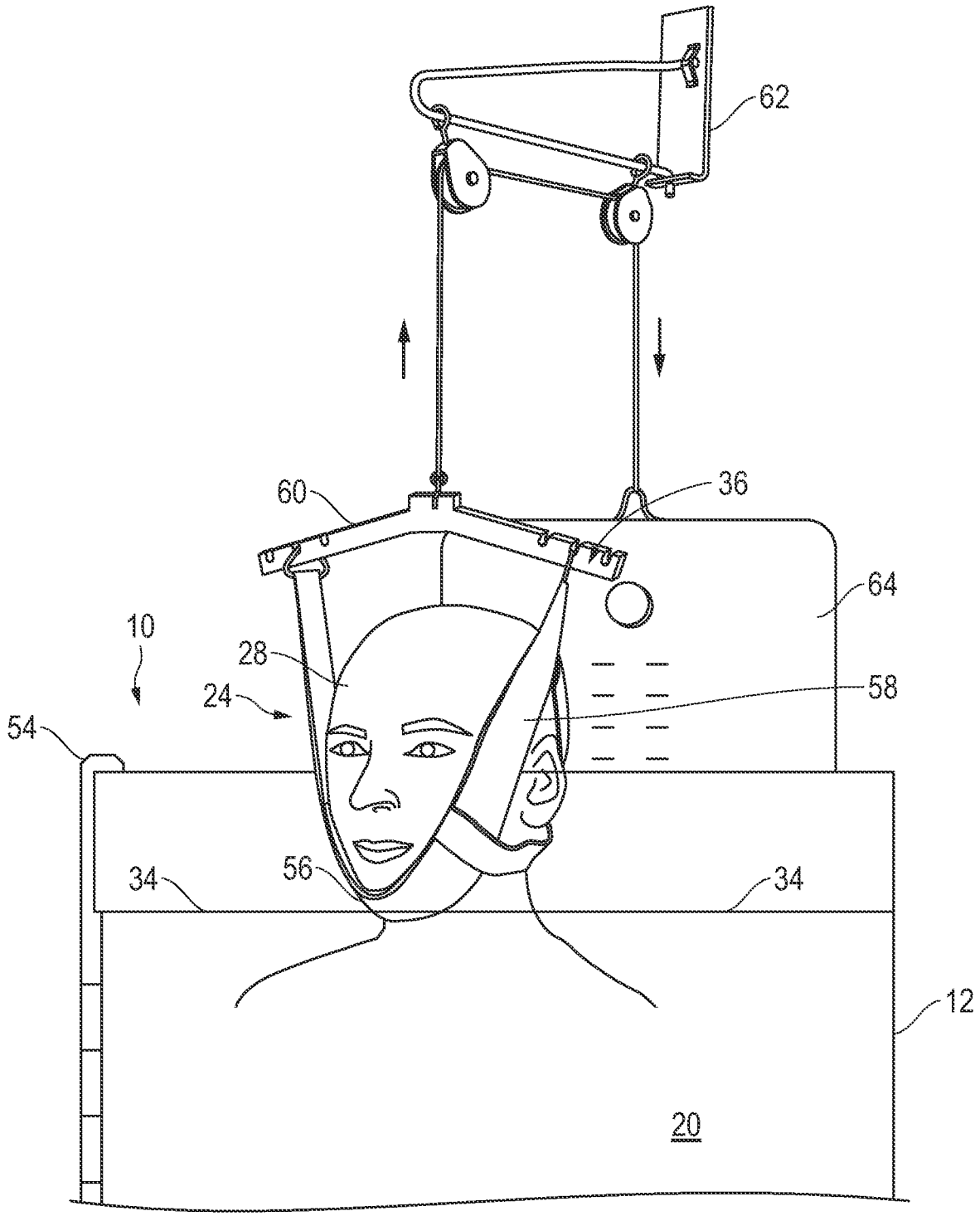
FIG. 2 is a front view of the invention of Figure illustrating a harness holding a user's chin above the water level.

A preferred embodiment of the present invention is illustrated by way of example in FIGS. 1-2. With specific reference to FIG. 1, lung exercise apparatus and method 10 includes enclosure 12, with an inside 14, an outside 16 and an open 18 top. Enclosure 12 is constructed so as to hold a liquid 20. Liquid 20 has a first density 1). An additive 22 is provided such that when additive 22 is added to the liquid 20 additive 22 increases the first density D such that a person 24 in the liquid 20 is more "buoyant". Again, all terms used herein are given their common meeting, such that the term "buoyant" describes the upward-directed force that a fluid (either liquid 20 or a gas) exerts on an object that is totally or partially immersed in the liquid 20. In one aspect, the liquid 20 is water and in one aspect, the additive 22 is salt, such as sea salt or epsom salt, for example only and not by limitation.

Weight 26 is provided that is removably connectable with the person 24 such that a person 24 in the enclosure 12 is held vertical. That is, the person's 24 head 28 is essentially directly above his or her legs 30 and feet 32 as shown, in the enclosure 12. In one aspect, the weight 26 consists of ankle weights as shown attached to the legs 30 above the feet 32 for example only.

Importantly, the person 24 is only partially, not totally, immersed in the liquid 20 below the surface 34 of the liquid 20 so that some of a person's 24 body is above the surface 34 of the liquid 20. Harness 36 (see FIG. 2) is removably connectable with the person 24 so as to hold some of the person's 24 body above the surface 34 of the liquid 20 and such that a person's 24 lungs 38 are below the surface 34 of the liquid 20 as shown.

Still referring to FIG. 1, in one aspect, the invention 10 further includes a pump 40 connected with the enclosure 12 for circulating the liquid 20 and the additive 22. Pump 40 may include filters and other components for ensuring that the desired level of liquid 20 and additive 22 is maintained, as are known and not described more fully hereafter.

In one aspect, heater 42 is connected with the enclosure 12 for heating the liquid 20. In one aspect, thermometer 44 is connected with the enclosure 12 for measuring the temperature of liquid 20 in the enclosure 12. In another aspect, a thermostat 46 is connected with the heater 42 for controlling the temperature of the heater 42.

In one aspect, enclosure 12 includes an outside 16, such as made from three-quarter inch thick plywood, for example only and not by limitation. Next, preferably, insulation 48 surrounds the inside 14 of enclosure 12. Insulation 48 may be an insulating material such as foam or any insulation now known or hereafter developed suitable for the purposes of the invention. In another aspect, a waterproof mattress 50 covers the inside 14 of the enclosure 12 such that a rigid outside 16 sandwiches insulation 48 between outside 16 and waterproof mattress 50 on the inside 14. Waterproof mattress 50 is preferably a soft, cushion material as is known, that holds liquid 20 in enclosure 12.

Preferably, the enclosure 12 is located partially below ground level 52. FIG. 1 illustrates a preferred embodiment of enclosure 12 which, for example only and not by limitation, has a thirty-six inch width "W", a fifty-one inch length "L" and a seventy-nine inch depth "Dp". As shown, however, preferably, most of the enclosure 12 is below ground level 52. As shown, only fourteen inches of enclosure 12 are above ground level 52. This makes it easier for a person 24 to get into and out of enclosure 12 and adds structural support surrounding the outside 16 of enclosure 12. Totally above ground enclosures 12 are certainly included within the scope of the present invention and, when needed, ladder 54 (see FIG. 2) is provided.

Referring now to FIG. 2, harness 36 is illustrated, for example only and not by limitation. As shown, harness 36 is configured to hold a person's 24 head 28 above the water level, surface 34. Preferably, the harness 36 is adjustable to hold a person's 24 chin 56 just above the water level surface 34.

Any type of harness 36 may be used that meets the requirements of the invention. FIG. 2 illustrates a harness 36 with a strap 58 that encircles the person's 24 head 28. A strap support 60 is connected with harness hanger 62. Upward lift on strap 58 is provided by weight bag 64. Certainly, other means and methods of supporting person's head 28, chin 56 just above water level surface 34 as are now known or hereafter developed are included within the scope of the invention.

By way of further description, lung exercise apparatus and method 10 includes a tank, enclosure 12, that is nearly filed with diluted sea salt and water, additive 22 and liquid 20. A person 24 in enclosure 12 is positioned such that, preferably, the person's 24 chin 56 is held just above surface 34 of liquid 20. Enclosure 12 is not filled completely and the surface 34 of the liquid 20 is below the open top 12 of enclosure 12. This feature accommodates the volume of liquid 20 that is displaced when a person 24 enters the enclosure 12 such that the liquid 20 does not spill out.

The amount of buoyancy can be adjusted by adding additive 22. Applicant has found that three hundred pounds of sea salt additive 22 works well with an enclosure 12 of the dimensions described herein. In any event, in use, additive 22 is added until the liquid 20 in the enclosure 12 is as dense or denser than the user's body.

Heater 42 maintains a comfortable water temperature. Harness 36 keeps the user's head 28/chin 52 just out of the water so as to provide maximum exercising effect on the lungs 38 and prevent the user's head from dropping into the water if the user goes to sleep in the comfortable enclosure 12. Varying the amount of dissolved salt and size/weight of the ankle weights 26 creates a unique exercise/health enhancing experience.

In use, a user steps into the recessed enclosure 12, or climbs in using ladder 54. When weights 36 are attached and the chin 56 is properly located as described, the user breathes in and out and all the water/liquid 20 surrounding the chest cavity is lifted and lowered. This act exercises and strengthen the lungs and muscles involved during breathing and does so in a gravity-less environment. Athletes, for example, by means of the present invention, can enhance their lung performance in a nearly fully submerged, gravity-less, temperature controlled, relaxing environment.

The description of the present embodiments of the invention has been for purposes of illustration, but is not intended to be exhaustive or to limit the invention to the form disclosed, Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A lung exercise apparatus comprising:

a. an enclosure, with an inside, an outside and an open top, configured to hold a liquid of a first density;

b. an additive to the liquid that increases the first density such that a person in said liquid is more buoyant;

c. weight removably connectable with said person such that a person in said enclosure is held vertical in said enclosure and partially immersed in said liquid below a surface of said liquid and with some of a person's body above said surface of the liquid; and d. a harness removably connectable with said person to hold some of said person's body above the surface of said liquid wherein lungs in a person's body are below the surface of said liquid.

2. The apparatus of claim 1 further including a pump connected with said enclosure for circulating said liquid and said additive.

3. The apparatus of claim 1 further including a heater connected with said enclosure for heating said liquid.

4. The apparatus of claim 3 further including a thermometer connected with said enclosure for measuring the temperature of liquid in said enclosure.

5. The apparatus of claim 4 further including a thermostat connected with said heater for controlling the temperature of said heater.

6. The apparatus of claim 1 further including insulation surrounding said enclosure.

7. The apparatus of claim 1 further including a waterproof mattress covering the inside of said enclosure.

8. The apparatus of claim 1 wherein the liquid is water.

9. The apparatus of claim 8 wherein the additive is salt.

10. A lung exercise apparatus comprising:

a. an enclosure, with an inside, an outside and an open top, configured to hold water with a first density at a water level below the open top and wherein the enclosure has an outside support exterior, an insulation layer and a waterproof mattress layer, the waterproof mattress layer forming the inside of said enclosure;

b. an additive to the water that increases the first density such that a person in said water is more buoyant;

c. weight removably connectable with said person such that a person in said enclosure is held vertical in said enclosure and partially immersed in said water below the water level of said water and with some of a person's body above the water level of the water;

d. a harness removably connectable with said person to hold some of said person's body above the water level of said water wherein lungs in a person's body are below the water level of said water;

e. a pump connected with said enclosure for circulating said water and said additive;

f. a heater connected with said enclosure for heating the water;

g. a thermometer connected with said enclosure for measuring the temperature of the water in said enclosure; and h. a thermostat connected with said heater for controlling the temperature of said heater.

11. The apparatus of claim 10 wherein the additive is salt.

12. The apparatus of claim 10 wherein the additive is sea salt.

13. The apparatus of claim 10 wherein the harness is configured to hold a person's head above the water level.

14. The apparatus of claim 13 wherein the harness is adjustable to hold a person's chin above the water level.

15. The apparatus of claim 10 wherein the weight consists of ankle weights.

16. The apparatus of claim 10 wherein the enclosure is located partially below ground level.

17. A lung exercise method comprising:

a. providing an enclosure, with an inside, an outside and an open top, configured to hold water with a first density at a water level below the open top and wherein the enclosure has an outside support exterior, an insulation layer and a waterproof mattress layer, the waterproof mattress layer forming the inside of said enclosure; an additive to the water that increases the first density such that a person in said water is more buoyant; weight removably connectable with said person such that a person in said enclosure is held vertical in said enclosure and partially immersed in said water below the water level of said water and with some of a person's body above the water level of the water; a harness removably connectable with said person to hold some of said person's body above the water level of said water wherein lungs in a person's body are below the water level of said water; a pump connected with said enclosure for circulating said water and said additive; a heater connected with said enclosure for heating the water; a thermometer connected with said enclosure for measuring the temperature of the water in said enclosure and a thermostat connected with said heater for controlling the temperature of said heater; and b. attaching said weight and harness to a person in said water such that a person's head is above the water level and such that breathing in and out raises and lowers the water level and exercises the lungs of said person.

18. The method of claim 17 further comprising:

a. adding more additive such that the buoyancy is increased; and b. adding more weight to compensate for said increased buoyancy whereby strain of exercising the lungs is increased.

19. The method of claim 17 further comprising:

a. a pump connected with said enclosure for circulating said water and said additive;

b. a heater connected with said enclosure for heating the water;

c. a thermometer connected with said enclosure for measuring the temperature of the water in said enclosure; and d. a thermostat connected with said beater for controlling the temperature of said heater.

20. The method of claim 17 wherein the enclosure is located partially below ground level.

* * * * *